US010845062B2

(12) United States Patent
Harward et al.

(10) Patent No.: US 10,845,062 B2
(45) Date of Patent: Nov. 24, 2020

(54) OVEN CAVITY RACK RETENTION

(71) Applicants: BSH Home Appliances Corporation, Irvine, CA (US); BSH Hausgeräte GmbH, Munich (DE)

(72) Inventors: Samuel Harward, Knoxville, TN (US); Matthew Moose, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 141 days.

(21) Appl. No.: 16/157,133

(22) Filed: Oct. 11, 2018

(65) Prior Publication Data

US 2020/0116362 A1 Apr. 16, 2020

(51) Int. Cl.
*F24C 15/16* (2006.01)

(52) U.S. Cl.
CPC ..... *F24C 15/16* (2013.01)

(58) Field of Classification Search
CPC ..... F24C 15/16
USPC ..... 126/339, 333, 340, 337 R; 248/215
See application file for complete search history.

(56) References Cited

U.S. PATENT DOCUMENTS 1,547,628 A 7/1925 Tinnerman
2,478,253 A * 8/1949 Doner ..... A47J 37/041 219/404
3,329,281 A * 7/1967 Ball ..... F25D 25/02 211/153
3,450,861 A * 6/1969 Hurko ..... F24C 15/16 219/404
4,138,019 A 2/1979 Smith
4,575,295 A 3/1986 Rebentisch
6,114,665 A * 9/2000 Garcia ..... F24C 7/06 126/333
2010/0218755 A1* 9/2010 Stewart ..... A47L 15/507 126/339

OTHER PUBLICATIONS

Hard to Find Fastener Flat Speed Nuts; Manufacturer: Unknown; Youtube.com; published Oct. 11, 2016.
Roush Performance; Roush Quarter Window Louvers—Installation Instructions, AmericanMuscle.com; Publication Unknow: Accessed Oct. 30, 2017.

(Continued)

*Primary Examiner* — Avinash A Savani
(74) *Attorney, Agent, or Firm* — Michael E. Tschupp; Andre Pallapies; Brandon G. Braun

(57) ABSTRACT

A system for securing an oven cavity rack includes an oven cavity rack; first and second fasteners passing through the oven cavity rack; a retaining body configured to be located in a space outside of the oven cavity; first and second retaining clips attached to the retaining body at first and second ends of the retaining body, the retaining clips each having a receiving feature that receives one of the fasteners. The first and second fasteners engage the retaining clips and are configured to draw the retaining clips toward the oven cavity to secure the oven cavity rack against an oven cavity side of an oven cavity wall, and when the first fastener is secured to the first retaining clip, the retaining body is positionally fixed by the first fastener such that the receiving feature of the second retaining clip remains aligned with an attachment point.

18 Claims, 6 Drawing Sheets

(56) References Cited

OTHER PUBLICATIONS

Puaggio; Body Panel Self Tapping Screws Spring (Spire) Clips; PedPart.co.uk; Publication Unknown: Accessed Oct. 25, 2017.
Toyota; Nylon U-Type Nut; FitFreak.net; Publication Oct. 26, 2014.
Erico; Caddy Slick Nut; Erico.com; Publication: 2017 Copyright date, Accessed Oct. 24, 2017.
Spring Nut U Nut; CHPSale.com; Publication Unknown: Accessed Oct. 25, 2017.

* cited by examiner

OVEN CAVITY RACK RETENTION

FIELD

The present invention relates generally to appliances. More specifically, particular embodiments of the invention relate to a system for retaining an oven cavity rack that supports shelves inside a cooking appliance.

BACKGROUND

Many domestic kitchens include an oven or range that has one or more shelves in the cooking space. The shelves are often retractable such that they slide in and out of the cooking space. The shelves can slide on oven cavity racks that include horizontal sections that support lateral sides of the shelves. There can be one oven cavity rack on each side of the cooking space.

Over time the oven cavity racks and/or the fasteners that secure them to an oven cavity wall can need replacement due to damage or wear. Another problem that can arise is fasteners loosening over time due to thermal expansion and contraction during heat cycling.

In some systems, a fastener is used to attach the oven cavity racks to a wall of the cooking space. A nut can be used on the end of the fastener. The nut can be located in a cavity between the wall of the cooking space and an exterior wall of the appliance or between the wall of the cooking space and thermal insulation located in the cavity. A problem can arise in that when the fastener is loosened to remove the oven cavity rack, the nut can fall down between the back side of the oven cavity and the appliance housing and be difficult to recover and reattach to the fastener.

Accordingly, an improved system is desired for effectively retaining the oven cavity racks while also permitting the quick and easy replacement of the oven cavity racks and/or the retaining bolts that secure the oven cavity racks to the oven cavity wall.

SUMMARY

An oven cavity rack retention system in accordance with embodiments of the invention helps prevent retaining hardware from falling into a space between the oven cavity wall and the appliance housing.

In one aspect, a domestic home cooking appliance configured to cook a food item includes an oven cavity configured to receive and cook the food item, the oven cavity having an oven cavity wall, the oven cavity wall having an oven cavity side and an appliance housing side opposite to the oven cavity side; an appliance housing around the oven cavity; a space between the oven cavity wall and the appliance housing; an oven cavity rack removably attached to the oven cavity side of the oven cavity wall at a first attachment point and at a second attachment point; a shelf inside the oven cavity, the shelf being supported by the oven cavity rack; a first fastener extending from the oven cavity to the space and passing through the oven cavity rack at the first attachment point; a second fastener extending from the oven cavity to the space and passing through the oven cavity rack at the second attachment point; a retaining body located on the appliance housing side of the oven cavity wall and in the space, the retaining body spanning the first attachment point and the second attachment point, the retaining body having a first end and a second end opposite the first end; a first retaining clip attached to the retaining body at the first end of the retaining body, the first retaining clip having a receiving feature that receives the first fastener; and a second retaining clip attached to the retaining body at the second end of the retaining body, the second retaining clip having a receiving feature that receives the second fastener. The first fastener engages the first retaining clip and draws the first retaining clip toward the oven cavity to secure the oven cavity rack against the oven cavity side of the oven cavity wall, the second fastener engages the second retaining clip and draws the second retaining clip toward the oven cavity to secure the oven cavity rack against the oven cavity side of the oven cavity wall, and when the first fastener is secured to the first retaining clip, the retaining body is positionally fixed by the first fastener such that the receiving feature of the second retaining clip aligns with the second attachment point.

In some embodiments, the retaining body has a first edge extending in a longitudinal direction from the first end to the second end, the first edge having a thickness in a thickness direction, a second edge extending in the longitudinal direction from the first end to the second end, the second edge having a thickness in the thickness direction, a main body extending in a lateral direction from the first edge to the second edge, the lateral direction being perpendicular to the longitudinal direction, the main body having a thickness in the thickness direction, the thickness of the first edge is greater than the thickness of the main body, the thickness of the second edge is greater than the thickness of the main body, and the thickness direction being perpendicular to the longitudinal direction and perpendicular to the lateral direction.

In one aspect, an oven cavity rack retention system is provided for securing an oven cavity rack in an oven cavity of a domestic home appliance, the oven cavity having an oven cavity wall, the oven cavity wall having an oven cavity side and an appliance housing side opposite to the oven cavity side, the domestic home appliance having an appliance housing around the oven cavity and a space between the oven cavity wall and the appliance housing. The system includes an oven cavity rack configured to be removably attached to the oven cavity side of the oven cavity wall at a first attachment point and at a second attachment point; a first fastener passing through the oven cavity rack at the first attachment point and configured to extend from the oven cavity to the space; a second fastener passing through the oven cavity rack at the second attachment point and configured to extend from the oven cavity to the space; a retaining body configured to be located on the appliance housing side of the oven cavity wall and in the space, the retaining body spanning the first attachment point and the second attachment point, the retaining body having a first end and a second end opposite the first end; a first retaining clip attached to the retaining body at the first end of the retaining body, the first retaining clip having a receiving feature that receives the first fastener; and a second retaining clip attached to the retaining body at the second end of the retaining body, the second retaining clip having a receiving feature that receives the second fastener. The first fastener engages the first retaining clip and is configured to draw the first retaining clip toward the oven cavity to secure the oven cavity rack against the oven cavity side of the oven cavity wall, the second fastener engages the second retaining clip and is configured to draw the second retaining clip toward the oven cavity to secure the oven cavity rack against the oven cavity side of the oven cavity wall, and when the first fastener is secured to the first retaining clip, the retaining body is positionally fixed by the first fastener such that the receiving feature of the second retaining clip aligns with the second attachment point.

In some embodiments, the retaining body has a first edge extending in a longitudinal direction from the first end to the second end, the first edge having a thickness in a thickness direction, a second edge extending in the longitudinal direction from the first end to the second end, the second edge having a thickness in the thickness direction, a main body extending in a lateral direction from the first edge to the second edge, the lateral direction being perpendicular to the longitudinal direction, the main body having a thickness in the thickness direction, the thickness of the first edge is greater than the thickness of the main body, the thickness of the second edge is greater than the thickness of the main body, and the thickness direction being perpendicular to the longitudinal direction and perpendicular to the lateral direction.

Further areas of applicability of the present invention will become apparent from the detailed description provided hereinafter. It should be understood that the detailed description and specific examples, while indicating preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
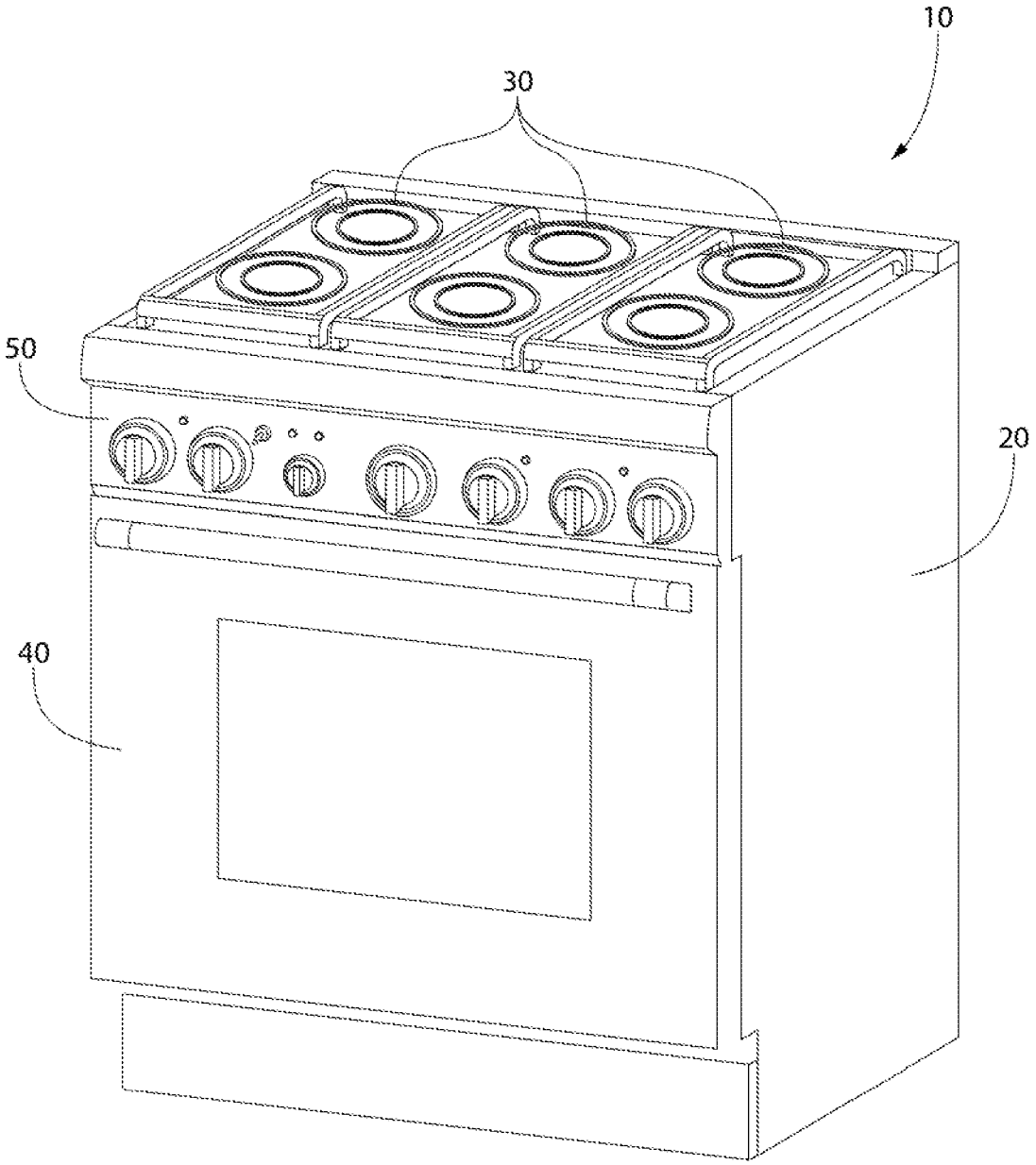
FIG. 1 is a perspective view of a range in accordance with exemplary embodiments of the invention.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The following description of the preferred embodiment(s) is merely exemplary in nature and is in no way intended to limit the invention, its application, or uses.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "connected," "coupled," "interconnected," and similar refer to a relationship wherein structures are secured or attached to one another either directly or indirectly through intervening structures, as well as both movable or rigid attachments or relationships, unless expressly described otherwise. The term "fixed" refers to two structures that cannot be separated without damaging one of the structures. The term "filled" refers to a state that includes completely filled or partially filled.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

As stated above, over time the oven cavity racks can need replacement due to damage or wear. Another problem is that fasteners can loosening over time due to thermal expansion and contraction during heat cycling. Because a retaining body of embodiments of the invention has two fixation points, it is not able to rotate and loosen on the back side of the cavity the same way that a nut would. Since nylon locking nuts cannot withstand the heat existing in oven applications, a geometry which locks the retaining body from rotating is an advantage. In some systems, a fastener is used to attach the oven cavity racks to a wall of the cooking space. A nut can be used on the end of the fastener. The nut can be located in a space between the wall of the cooking space and an exterior wall of the appliance or between the wall of the cooking space and thermal insulation located in the cavity. A problem can arise in that when the fastener is loosened to remove the oven cavity rack, the nut can fall down in the space between the back side of the oven cavity wall/cooking space and the appliance housing and be difficult to recover and reattach to the fastener. Also, a nylon nut or a nut having a nylon or other non-metal component can be damaged due to melting resulting from the heat generated by the cooking device.

Embodiments of the invention address this problem by providing a retaining body that is attached to the oven cavity rack by two spaced-apart fasteners. Accordingly, an improved system is provided that effectively retains the oven cavity racks while also permitting the quick and easy replacement of the oven cavity racks and/or the retaining bolts that secure the oven cavity racks to the oven cavity wall.

FIG. 1 shows an example of a cooking appliance 10 in accordance with embodiments of the invention. In embodiments, cooking appliance 10 is a range or oven. Embodiments of the invention can be any cooking appliance that has a cooking space inside the cooking appliance. In this example, cooking appliance 10 has an appliance housing 20 that extends around cooking appliance 10 and houses many of the features of cooking appliance 10. Cooking appliance 10 has a plurality of heating units 30, in this example heating rings, located on the top of cooking appliance 10. Other examples have one or more heating units that are, for example, gas burners, induction units, griddles, etc. In this example, cooking appliance 10 has a door 40 that provides access to a cooking space (oven cavity) inside cooking appliance 10. Cooking appliance 10 has a control panel 50 that has a plurality of controls for controlling various features of cooking appliance 10.

Figure 2:
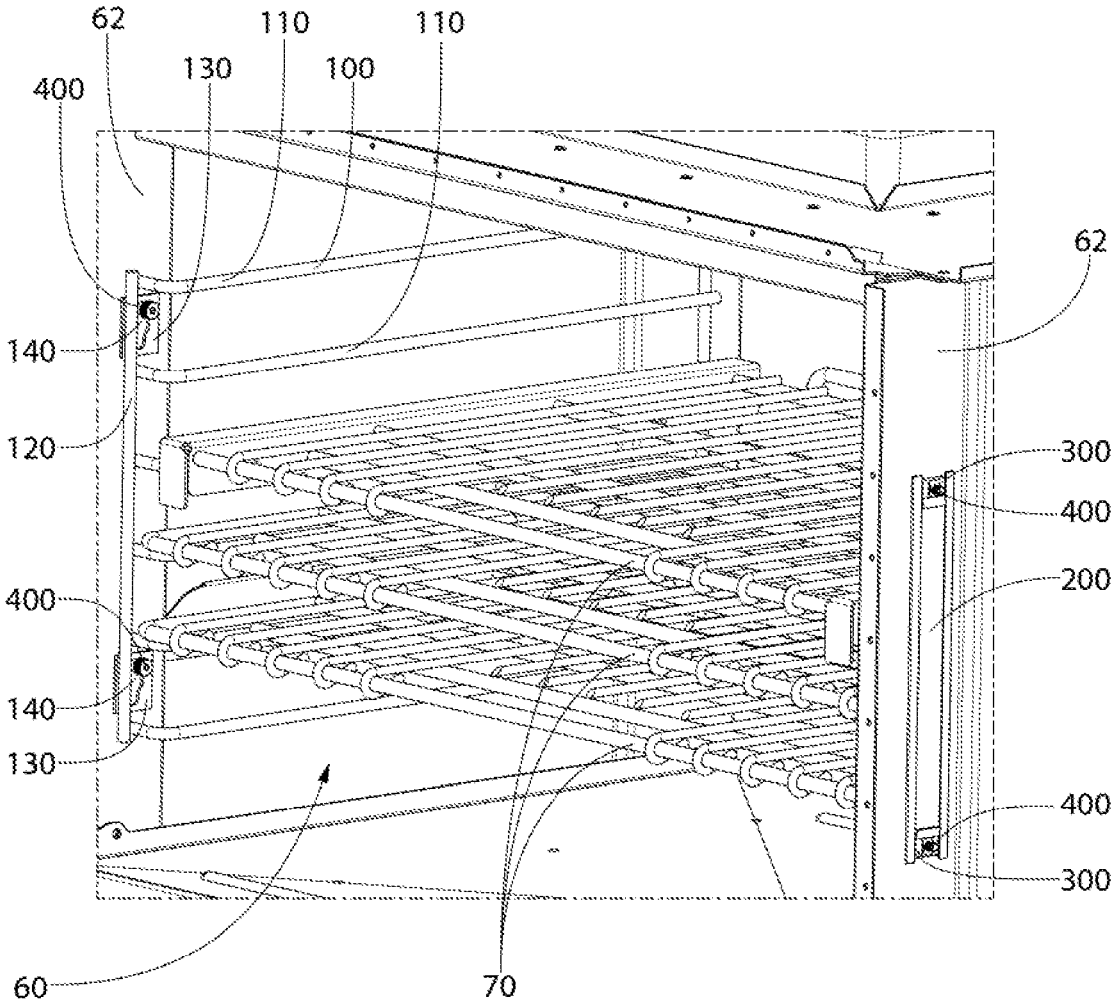
FIG. 2 is a partial perspective view of an oven cavity in accordance with exemplary embodiments of the invention.

FIG. 2 shows an example of cooking appliance 10 with door 40 open to show oven cavity 60. Three shelves 70 are shown in oven cavity 60 in this example. More or fewer shelves 70 can be provided. In addition, one or more of shelves 70 can be fixed or sliding. In this example, shelves 70 are sliding shelves that slide on an oven cavity rack 100. Although one oven cavity rack 100 is shown in FIG. 2, another oven cavity rack 100 is provided on an opposite inside wall of oven cavity 60. Oven cavity rack 100 has a plurality of horizontal rails 110 on which shelves 70 can be placed to slide in and out of oven cavity 60. In this example, oven cavity rack 100 has six horizontal rails 110. In other examples, more or fewer horizontal rails 110 can be provided. Horizontal rails 110 are attached to each other by, in this example, two vertical rails 120. This example has one vertical rail 120 near the front of oven cavity 60 and one vertical rail 120 near the back of oven cavity 60.

Oven cavity 60 has a side oven cavity wall 62 that forms a part of an enclosure that forms oven cavity 60. Oven cavity 60 also has a rear oven cavity wall, a top oven cavity wall, a bottom oven cavity wall, and a second side oven cavity wall. The opposite side oven cavity wall has attached to it a second oven cavity rack 100 identical or similar to oven cavity rack 100 described herein. Door 40 forms the remaining wall of oven cavity 60 when door 40 is in a closed position.

Vertical rail 120 is removably attached to oven cavity wall 62 at, in this example, two locations by brackets 130. In this example, brackets 130 are welded to vertical rail 120, but any other appropriate attachment method can be used. In this example, there are two brackets 130, but in other examples three or more brackets 130 are used. Each bracket 130 has an aperture 140, in this example it is a slot, for receiving a fastener 400. In this example, fastener 400 is a threaded shoulder bolt (explained in more detail below). In other examples, fastener 400 is some other type of threaded fastener, a quarter-turn fastener, or some other type of removable fastener.

FIG. 2 shows a retaining body 200 located on the side of oven cavity wall 62 that is opposite to oven cavity 60. A second retaining body 200 is located on the other side of oven cavity 60 to correspond to brackets 130 shown in FIG. 2.

Figure 3:
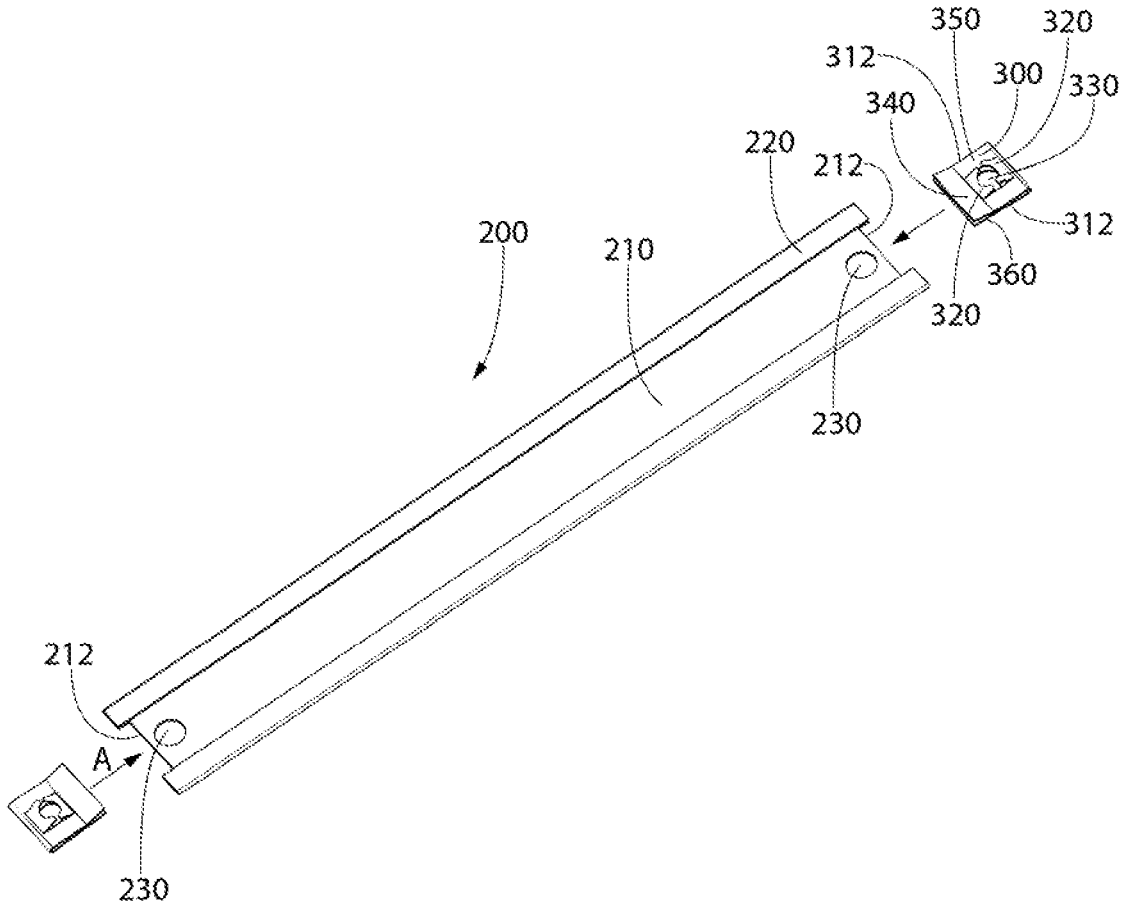
FIG. 3 is an exploded perspective view of a system in accordance with exemplary embodiments of the invention.

FIG. 3 shows an example of retaining body 200 in accordance with embodiments of the invention. In this example, retaining body 200 has a central body 210 and two edges 220. Edges 220 are thicker in this example than is central body 210. The thicker edges 220 provide more rigidity to retaining body 200 and also provide a restraining feature that locates fastener receivers 300 (explained in detail below). In this example central body 210 and edges 220 are formed from a single piece of sheet metal that is folded to create edges 220. As a result, edges 220 in this example are twice as thick as central body 210. While sheet metal is used in this example, other sheet material can be used, or other methods of manufacture can be used such as, for example, extruding, machining, rolling casting, etc. Two apertures 230 are formed in central body 210 in order to provide a passage for fasteners 400 (explained in more detail below). The longitudinal spacing between apertures 230 corresponds to the spacing between fasteners 400 (shown in FIG. 2). In embodiments, apertures 230 are located in the lateral center of central body 210. In other embodiments, apertures 230 are offset from the lateral center of central body 210. In embodiments of the invention, each end of retaining body 200 is provided with a fastener receiver 300 that receives and engages fastener 400. In this example, fastener receiver 300 is a metal clip 300 that has a hole 330 formed by two tabs 320. Tabs 320 form, in this example, hole 330 such that they act as threads to receive fastener 400 and engage the threads on fastener 400 as a nut engages the threads of a bolt. In some embodiments, hole 330 and tabs 320 are shaped to receive a quarter-turn fastener or whatever type fastener 400 is being used. Whatever type fastener 400 is being used, when fastener 400 engages fastener receiver 300 and is tightened, fastener receiver 300 is drawn closer to the end of fastener 400 that is in the oven cavity. In this way, retaining body 200 is drawn tight to the outside of oven cavity wall 62 when fasteners 400 are tightened.

Fastener receiver 300 is, in this example, formed by bending a piece of sheet metal into a sprung clip with a top portion 350 and a bottom portion 360. Fastener receiver 300 has an angled portion 340 in top portion 350 that creates a space between the top portion 350 and bottom portion 360 that facilitates assembly of fastener receiver 300 and retaining body 200.

To assemble fastener receivers 300 to retaining body 200, in this example, fastener receivers 300 are pushed into retaining body 300 in the direction of Arrow A in FIG. 3 to the point where fastener receiver 300 contacts an end edge 212 of central body 210. Once in the fully installed position where fastener receiver 300 contacts end edge 212 and hole 330 aligns with aperture 230, fastener receiver 300 is limited in its movement in a lateral direction by edges 220. Because edges 220 are thicker than central body 210, sides 312 will contact edges 220 if fastener receiver 300 is moved laterally more than a predetermined distance from center.

Figure 4:
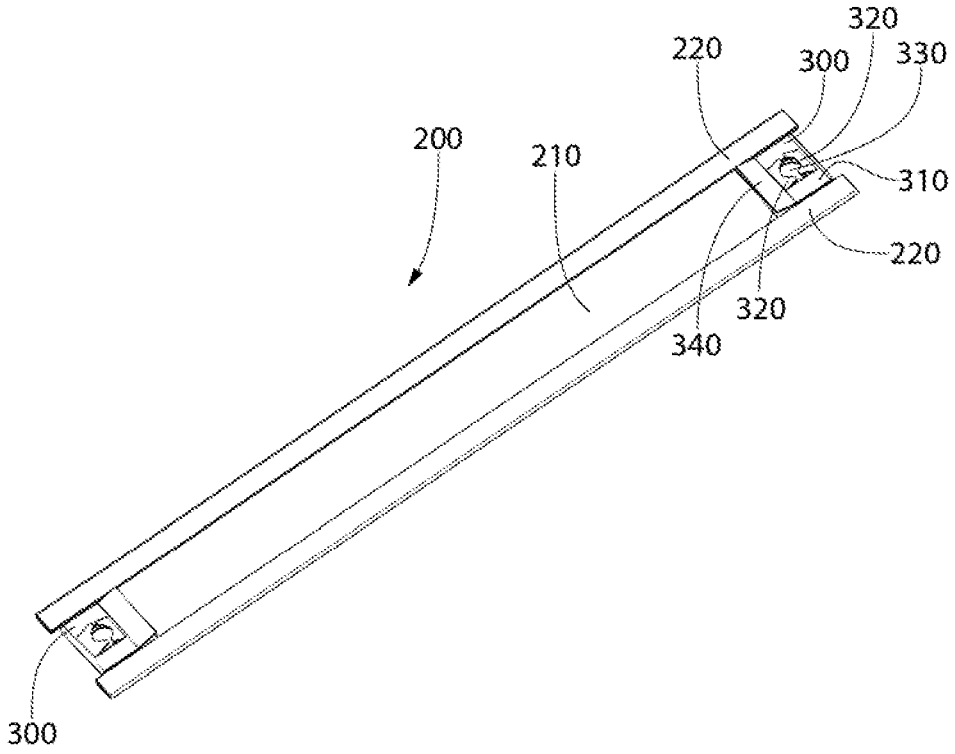
FIG. 4 an assembled view of the system of FIG. 3.

FIG. 4 shows the retaining body 200 and the two fastener receivers 300 of FIG. 3 in an assembled state. In this assembled state, edges 220 restrict lateral movement of fastener receiver 300 such that holes 330 align with apertures 230 to the extent that apertures 230 allow fasteners 400 to pass through central body 210 and engage tabs 320 of fastener receivers 300. In some embodiments, edges 220 restrict lateral movement of fastener receiver 300 such that the center of hole 330 is colinear with the center of aperture 230. In other embodiments, where hole 330 and aperture 230 are different sizes and/or different shapes, edges 220 restrict lateral movement of fastener receiver 300 such that hole 330 and aperture 230 are aligned to the extent that neither hole 330 nor aperture 230 is obstructed in any way by the other of hole 330 and aperture 230. In other embodiments, edges 220 restrict lateral movement of fastener receiver 300 such that fastener receiver 300 can move laterally between two points where hole 330 is offset from aperture 230 but they overlap to an extent where fastener 400 can pass through aperture 230 and engage tabs 320 of fastener receiver 300 without the user contacting fastener receiver 300 other than with fastener 400. In some embodiments, edges 220 restrict lateral movement of fastener receiver 300 such that fastener receiver 300 can move laterally between the two points where the center of hole 330 is offset from the center of aperture 230 by slightly less than the diameter of hole 330. This allows for enough of an overlap of hole 330 and aperture 230 that a point of fastener 400 can pass through hole 320 and move fastener receiver 300 laterally as fastener 400 engages tabs 320 of fastener receiver 300. In some embodiments, edges 220 restrict lateral movement of fastener receiver 300 such that fastener receiver 300 can move laterally between the two points where the center of hole 330 is offset from the center of aperture 230 by one half of the diameter of hole 330. This allows for more of fastener 400 to pass through hole 320 before fastener 400 engages tabs 320 of fastener receiver 300 and begins to move fastener receiver 300 laterally. In embodiments, aperture 230 and hole 330 are circular and aperture 230 has a diameter that is larger than a diameter of hole 330. This size difference can facilitate insertion of fastener 400 and can permit full overlap of hole 330 and aperture 230 while fastener receiver 300 is offset from the center of main body 210.

Figure 5:
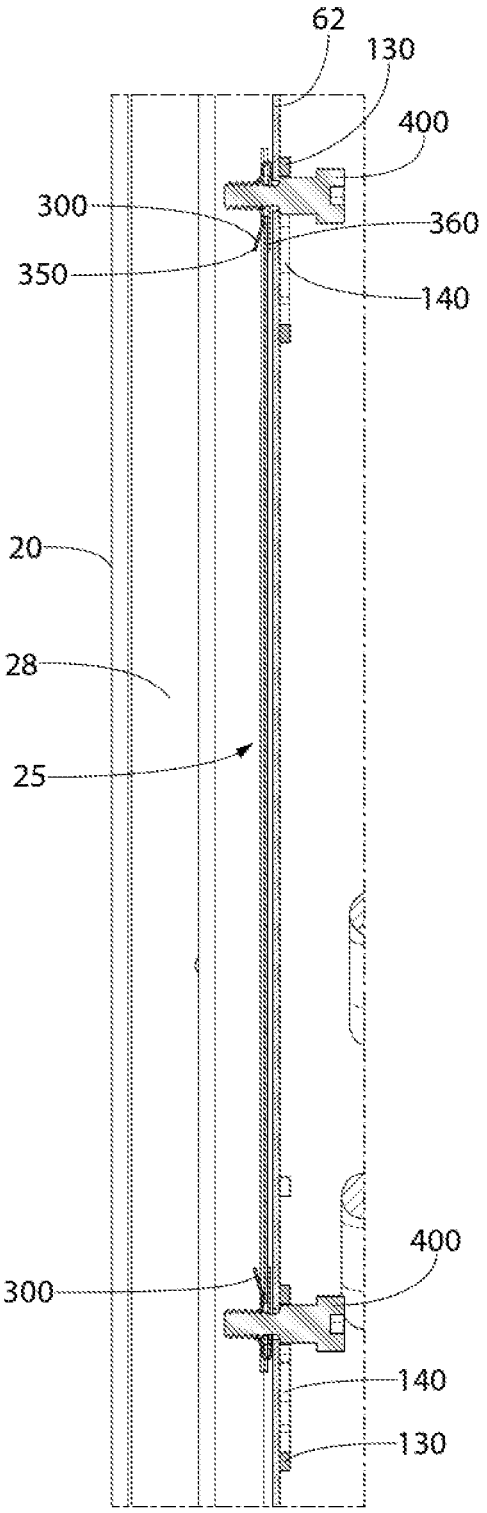
FIG. 5 is a sectional view of a system in accordance with exemplary embodiments of the invention.

As described above and shown in FIGS. 2-5, retaining body 200 has two fastener receivers 300 (one at each end of retaining body 200). An object of the invention is to permit the removal and/or replacement of fasteners 400 without the user having to have access to a void 25 that is located between oven cavity wall 62 and appliance housing 20. As shown in FIGS. 2 and 5, retaining body 200 (and fastener retainers 300) are located in void 25. In this example, insulation 28 is located between void 25 and appliance housing 20. In other examples, insulation 28 is in void 25 and contacts retaining body 200 and/or fasteners 400. In many of these configurations, it is difficult for a user to access fastener receivers that engage fasteners 400. In appliances that do not use a retaining body, removal of a fastener that fastens an oven cavity rack to an oven cavity wall can result in a nut that is engaged by the fastener falling into a void outside of the oven cavity wall and/or the nut becoming misaligned with the hole in the oven cavity wall such that the user cannot align the fastener with the nut. By providing retaining body 200, embodiments of the invention address this issue by securing the location of fastener receivers 300 relative to the apertures 140 in brackets 130. Referring to FIG. 5, when the upper fastener 400 is removed, the lower fastener 400 keeps retaining body 200 from moving so that aperture 230 remains sufficiently aligned with aperture 140 for the upper fastener 400 (or its replacement) to be inserted and engage tabs 320 of upper fastener receiver 300. By the lower fastener 400 in FIG. 5 remaining securely in place and keeping force on retaining body 200, retaining body 200 is prevented from moving. This provides a great advantage over appliances where the nut or other fastener receiver can move relative to the position in which it needs to be in order for the fastener to engage it. Once the upper fastener 400 (or its replacement) has been securely fastened to fastener receiver 300, the lower fastener 400 can be removed and/or replaced while the upper fastener 400 keeps retaining body 200 securely positionally fixed. While this example replaces the upper fastener 400 first and the lower fastener 400 second, the fasteners 400 can also be replaced in the reverse order.

In the example shown in the Figures, fasteners 400 are shoulder bolts and oven cavity rack 100 can be lifted up and off of fasteners 400 without loosening fasteners 400 due to the shape of apertures 140.

Embodiments of the invention also provide an advantage over appliances which have a nut welded in position because it avoids the added expense and process of welding a nut in place on the oven cavity wall.

Figure 6:
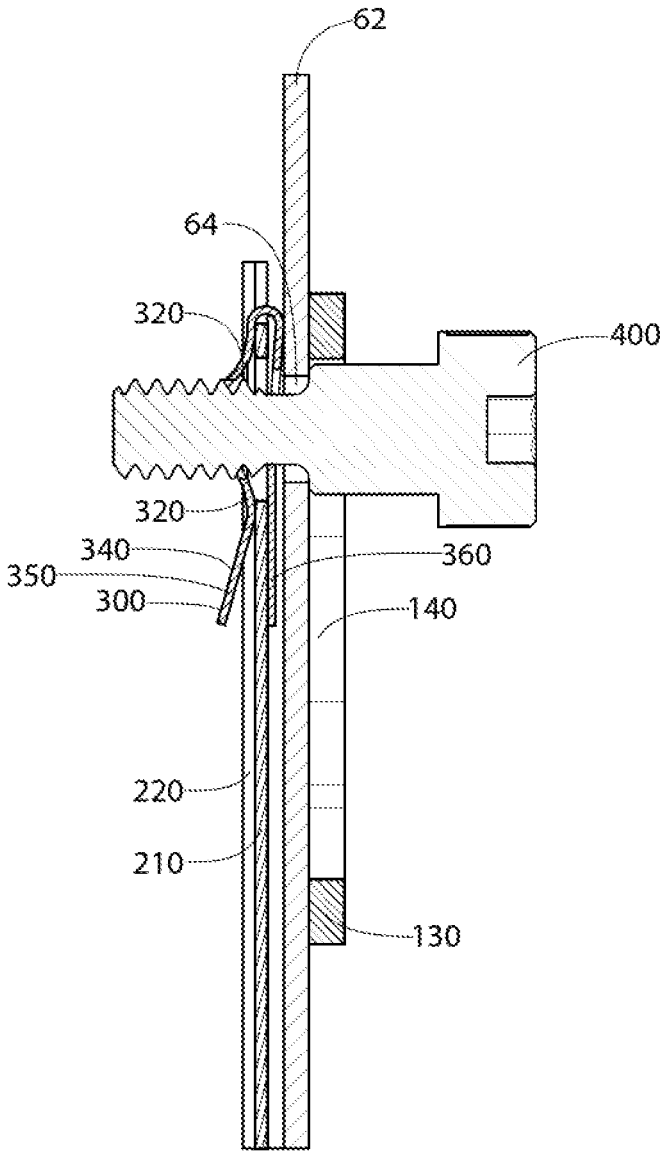
FIG. 6 is a partial sectional view of the system of FIG. 5.

FIG. 6 shows a magnified version of part of FIG. 5 and shows the interaction between threads of fastener 400 and tabs 320 of fastener receiver 300. FIG. 6 also shows the interaction between top portion 350 and bottom portion 360 of fastener receiver 300 and central body 210 of retainer body 200. In this example, top portion 350 and bottom portion 360 pinch central body 210 to provide resistance so fastener receiver 300 remains attached to retainer body 200 when fastener 400 is not in place.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents. In addition, all combinations of any and all of the features described in the disclosure, in any combination, are part of the invention.

What is claimed is:

1. A domestic home cooking appliance configured to cook a food item, comprising:

an oven cavity configured to receive and cook the food item, the oven cavity having an oven cavity wall, the oven cavity wall having an oven cavity side and an appliance housing side opposite to the oven cavity side;

an appliance housing around the oven cavity;

a space between the oven cavity wall and the appliance housing;

an oven cavity rack removably attached to the oven cavity side of the oven cavity wall at a first attachment point and at a second attachment point;

a shelf inside the oven cavity, the shelf being supported by the oven cavity rack;

a first fastener extending from the oven cavity to the space and passing through the oven cavity rack at the first attachment point;

a second fastener extending from the oven cavity to the space and passing through the oven cavity rack at the second attachment point;

a retaining body located on the appliance housing side of the oven cavity wall and in the space, the retaining body spanning the first attachment point and the second attachment point, the retaining body having a first end and a second end opposite the first end;

a first retaining clip attached to the retaining body at the first end of the retaining body, the first retaining clip having a receiving feature that receives the first fastener; and a second retaining clip attached to the retaining body at the second end of the retaining body, the second retaining clip having a receiving feature that receives the second fastener, wherein the first fastener engages the first retaining clip and draws the first retaining clip toward the oven cavity to secure the oven cavity rack against the oven cavity side of the oven cavity wall, the second fastener engages the second retaining clip and draws the second retaining clip toward the oven cavity to secure the oven cavity rack against the oven cavity side of the oven cavity wall, when the first fastener is secured to the first retaining clip, the retaining body is positionally fixed by the first fastener such that the receiving feature of the second retaining clip aligns with the second attachment point, the first retaining clip slidingly engages the first end of the retaining body, and the second retaining clip slidingly engages the second end of the retaining body.

2. The appliance of claim 1, wherein the retaining body has a first edge extending in a longitudinal direction from the first end to the second end, the first edge having a thickness in a thickness direction, a second edge extending in the longitudinal direction from the first end to the second end, the second edge having a thickness in the thickness direction, a main body extending in a lateral direction from the first edge to the second edge, the lateral direction being perpendicular to the longitudinal direction, the main body having a thickness in the thickness direction, the thickness of the first edge is greater than the thickness of the main body, the thickness of the second edge is greater than the thickness of the main body, and the thickness direction being perpendicular to the longitudinal direction and perpendicular to the lateral direction.

3. The appliance of claim 2, wherein the first clip has a width in the lateral direction that is less than a width in the lateral direction of the main body at the first end of the retaining body.

4. The appliance of claim 3, wherein the receiving feature of the first retaining clip has a width in the lateral direction, and a sum of the width of the first clip and the width of the receiving feature of the first retaining clip is greater than the width of the main body at the first end of the retaining body.

5. The appliance of claim 3, wherein the receiving feature of the first retaining clip has a width in the lateral direction, and a sum of the width of the first clip and one half of the width of the receiving feature of the first retaining clip is greater than the width of the main body at the first end of the retaining body.

6. The appliance of claim 5, wherein the retaining body has a first aperture adjacent the first end of the retaining body, the first aperture having a width in the lateral direction, the first fastener extends though the first aperture when the first fastener extends from the oven cavity to the space and passes through the oven cavity rack at the first attachment point, the retaining body has a second aperture adjacent the second end of the retaining body, the second aperture having a width in the lateral direction, and the second fastener extends though the second aperture when the second fastener extends from the oven cavity to the space and passes through the oven cavity rack at the second attachment point.

7. The appliance of claim 4, wherein the retaining body has a first aperture adjacent the first end of the retaining body, the first aperture having a width in the lateral direction, the first fastener extends though the first aperture when the first fastener extends from the oven cavity to the space and passes through the oven cavity rack at the first attachment point, the retaining body has a second aperture adjacent the second end of the retaining body, the second aperture having a width in the lateral direction, and the second fastener extends though the second aperture when the second fastener extends from the oven cavity to the space and passes through the oven cavity rack at the second attachment point.

8. The appliance of claim 7, wherein the first edge and the second edge limit movement of the first retaining clip in the lateral direction, and the first edge and the second edge limit movement of the second retaining clip in the lateral direction.

9. The appliance of claim 3, wherein the first edge and the second edge limit movement of the first retaining clip in the lateral direction, and the first edge and the second edge limit movement of the second retaining clip in the lateral direction.

10. An oven cavity rack retention system for securing an oven cavity rack in an oven cavity of a domestic home appliance, the oven cavity having an oven cavity wall, the oven cavity wall having an oven cavity side and an appliance housing side opposite to the oven cavity side, the domestic home appliance having an appliance housing around the oven cavity and a space between the oven cavity wall and the appliance housing, the system comprising:

an oven cavity rack configured to be removably attached to the oven cavity side of the oven cavity wall at a first attachment point and at a second attachment point;

a first fastener passing through the oven cavity rack at the first attachment point and configured to extend from the oven cavity to the space;

a second fastener passing through the oven cavity rack at the second attachment point and configured to extend from the oven cavity to the space;

a retaining body configured to be located on the appliance housing side of the oven cavity wall and in the space, the retaining body spanning the first attachment point and the second attachment point, the retaining body having a first end and a second end opposite the first end;

a first retaining clip attached to the retaining body at the first end of the retaining body, the first retaining clip having a receiving feature that receives the first fastener; and a second retaining clip attached to the retaining body at the second end of the retaining body, the second retaining clip having a receiving feature that receives the second fastener, wherein the first fastener engages the first retaining clip and is configured to draw the first retaining clip toward the oven cavity to secure the oven cavity rack against the oven cavity side of the oven cavity wall, the second fastener engages the second retaining clip and is configured to draw the second retaining clip toward the oven cavity to secure the oven cavity rack against the oven cavity side of the oven cavity wall, when the first fastener is secured to the first retaining clip, the retaining body is positionally fixed by the first fastener such that the receiving feature of the second retaining clip aligns with the second attachment point, the first retaining clip slidingly engages the first end of the retaining body, and the second retaining clip slidingly engages the second end of the retaining body.

11. The system of claim 10, wherein the retaining body has a first edge extending in a longitudinal direction from the first end to the second end, the first edge having a thickness in a thickness direction, a second edge extending in the longitudinal direction from the first end to the second end, the second edge having a thickness in the thickness direction, a main body extending in a lateral direction from the first edge to the second edge, the lateral direction being perpendicular to the longitudinal direction, the main body having a thickness in the thickness direction, the thickness of the first edge is greater than the thickness of the main body, the thickness of the second edge is greater than the thickness of the main body, and the thickness direction being perpendicular to the longitudinal direction and perpendicular to the lateral direction.

12. The system of claim 11, wherein the first clip has a width in the lateral direction that is less than a width in the lateral direction of the main body at the first end of the retaining body.

13. The system of claim 12, wherein the receiving feature of the first retaining clip has a width in the lateral direction, and a sum of the width of the first clip and the width of the receiving feature of the first retaining clip is greater than the width of the main body at the first end of the retaining body.

14. The system of claim 12, wherein the receiving feature of the first retaining clip has a width in the lateral direction, and a sum of the width of the first clip and one half of the width of the receiving feature of the first retaining clip is greater than the width of the main body at the first end of the retaining body.

15. The system of claim 14, wherein the retaining body has a first aperture adjacent the first end of the retaining body, the first aperture having a width in the lateral direction, the first fastener extends though the first aperture when the first fastener extends from the oven cavity to the space and passes through the oven cavity rack at the first attachment point, the retaining body has a second aperture adjacent the second end of the retaining body, the second aperture having a width in the lateral direction, and the second fastener extends though the second aperture when the second fastener extends from the oven cavity to the space and passes through the oven cavity rack at the second attachment point.

16. The system of claim 13, wherein the retaining body has a first aperture adjacent the first end of the retaining body, the first aperture having a width in the lateral direction, the first fastener extends though the first aperture when the first fastener extends from the oven cavity to the space and passes through the oven cavity rack at the first attachment point, the retaining body has a second aperture adjacent the second end of the retaining body, the second aperture having a width in the lateral direction, and the second fastener extends though the second aperture when the second fastener extends from the oven cavity to the space and passes through the oven cavity rack at the second attachment point.

17. The system of claim 16, wherein the first edge and the second edge limit movement of the first retaining clip in the lateral direction, and the first edge and the second edge limit movement of the second retaining clip in the lateral direction.

18. The system of claim 12, wherein the first edge and the second edge limit movement of the first retaining clip in the lateral direction, and the first edge and the second edge limit movement of the second retaining clip in the lateral direction.

* * * * *